US010077770B2

(12) United States Patent
Chou

(10) Patent No.: US 10,077,770 B2
(45) **Date of Patent: *Sep. 18, 2018**

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 364 days.

This patent is subject to a terminal disclaimer.

(21) Appl. No.: 14/739,952

(22) Filed: Jun. 15, 2015

(65) Prior Publication Data

US 2015/0377230 A1 Dec. 31, 2015

(30) Foreign Application Priority Data

Jun. 27, 2014 (TW) ..... 103122391 A

(51) Int. Cl.

| | |
|---|---|
| ***F04B 39/12*** | (2006.01) |
| ***F04B 53/08*** | (2006.01) |
| ***F04B 39/06*** | (2006.01) |
| ***F04B 53/16*** | (2006.01) |
| *F04B 35/01* | (2006.01) |
| *F04B 35/04* | (2006.01) |
| *F04B 39/14* | (2006.01) |
| *F04B 41/02* | (2006.01) |
| *F04B 53/10* | (2006.01) |

(52) U.S. Cl.

CPC ..... *F04B 53/08* (2013.01); *F04B 39/066* (2013.01); *F04B 39/12* (2013.01); *F04B 53/16* (2013.01); *F04B 35/01* (2013.01); *F04B 35/04* (2013.01); *F04B 39/14* (2013.01); *F04B 41/02* (2013.01); *F04B 53/10* (2013.01); *F05C 2225/00* (2013.01)

(58) Field of Classification Search

CPC ..... F04B 53/08; F04B 39/06; F04B 39/066; F04B 39/12; F04B 39/121; F04B 39/127; F04B 53/16; F04B 53/162

See application file for complete search history.

(56) References Cited

U.S. PATENT DOCUMENTS

| | | | | |
|---|---|---|---|---|
| 6,431,839 B2 * | 8/2002 | Gruber | F02B 63/02 415/76 |
| 2008/0145245 A1 * | 6/2008 | Chou | B29C 73/166 417/415 |
| 2012/0186355 A1 * | 7/2012 | Wang | F04B 33/005 73/744 |

* cited by examiner

*Primary Examiner* — Bryan Lettman

(57) ABSTRACT

A portable air compressor includes a box and a compressor unit accommodated in the box. The compressor unit includes a main frame, a cylinder fitted with a piston body, a motor, and a transmission mechanism. The motor drives the transmission mechanism to have the piston body conduct reciprocating motion in the cylinder to produce compressed air, which is transferred to an air storage container. The cylinder and the main frame are integrally formed of plastic. The cylinder defines an exit hole communicating with an inner space thereof. A metal seat is integrally formed at the cylinder. The central hole of the metal seat communicates with the exit hole of the cylinder. A plug is urged by a compression spring to seal the central hole of the metal seat. The metal seat can endure high temperature within the cylinder to ensure air-tightness between the plug and the metal seat.

7 Claims, 8 Drawing Sheets

AIR COMPRESSOR

(a) TECHNICAL FIELD OF THE INVENTION

The present invention relates to a portable air compressor and, more particularly, to a portable air compressor, including a box and a compressor unit accommodated in the box, which has an enhanced performance of compressing air and can dissipate the heat accumulated in the box more effectively.

(b) DESCRIPTION OF THE PRIOR ART

Air compressors are usually employed to inflate objects such as air cushions or tires. Generally, portable air compressors are manufactured in small size, so that they can be carried easily. Furthermore, a portable air compressor can be powered by a handheld DC power supply or a cigarette lighter socket in a vehicle. Conventionally, a portable air compressor employs a box to accommodate a compressor unit therein, wherein the compressor unit employs a motor to drive a piston body to conduct reciprocating motion in a cylinder to produce compressed air, which can be transferred to an air storage container provided with multiple outlets, one of which can be connected by a hose to an object that needs to be inflated. A conventional compressor unit is provided, between the cylinder and the air storage container thereof, with an exit port, which is sealed by a plug. Due to the cylinder being made of plastic, after a period of use, the top of the cylinder become uneven, so that air-tightness between the plug and the top of the cylinder will be affected, thereby reducing the performance of compressing air. Besides, in a conventional air compressor, the heat accumulated in the box is not easy to escape therefrom; therefore, the operational safety is also affected.

In view of the foregoing, there is a need to develop a portable air compressor, including a box and an electrically operated control unit, which can endure high temperature during operation of the control unit to ensure air-tightness between the plug and the cylinder of the control unit, and can dissipate the heat accumulated in the box more effectively.

SUMMARY OF THE INVENTION

One object of the present invention is to provide a portable air compressor, including a box and an electrically operated compressor unit accommodated in the box, which has an enhanced performance of compressing air and can dissipate the heat accumulated in the box more effectively.

Specifically, the compressor unit includes a main frame, a cylinder fitted with a piston body, a motor, and a transmission mechanism. The motor and the transmission mechanism are mounted to the main frame. The motor drives the transmission mechanism to have the piston body conduct reciprocating motion in the cylinder to produce compressed air in an inner space of the cylinder, which can be transferred to an air storage container provided with a plurality of outlets. The cylinder and the main frame are integrally formed of plastic. The cylinder defines an exit hole communicating with the inner space thereof. A metal seat defining therein a central hole is integrally formed at the cylinder, above the exit hole of the cylinder, wherein the central hole of the metal seat communicates with the exit hole of the cylinder. The compressed air produced in the inner space of the cylinder can be transferred to the air storage container via the exit hole of the cylinder and the central hole of the metal seat. A plug is provided in the air storage container and urged by a compression spring to seal the central hole of the metal seat when the air pressure in the cylinder is less than a predetermined pressure. The metal seat is capable of enduring high temperature within the cylinder during operation of the compressor unit to ensure air-tightness between the plug and the metal seat.

One feature of the present invention is that the exit hole of the cylinder and the central hole of the metal seat can serve as an auxiliary chamber for storing compressed air.

Another feature of the present invention is that the box includes a cover and a base. The cover is provided with a plurality of upper partitioning walls, while the base is provided with a plurality of lower partitioning walls corresponding to the upper partitioning walls, so that a generally L-shaped space is defined to accommodate the cooling fan, the motor, the main frame together with the transmission mechanism, the cylinder together with the piston body, and the air storage container. The box is provided with an air entrance port at one end of the generally L-shaped space, near the cooling fan, and provided with an air exit port at the other end of the generally L-shaped space, near the air storage container. Outside air is drawn by the cooling fan to induce an airflow that flows along the generally L-shaped space, wherein one part of the airflow may flow over the cylinder to dissipate the heat on the outer surface of the cylinder, and another part of the airflow may flow into the inner space of the cylinder to dissipate the heat accumulated in the cylinder, so that the heat of the cylinder can be dissipated more effectively. Therefore, the performance and safety of the control unit can be increased.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
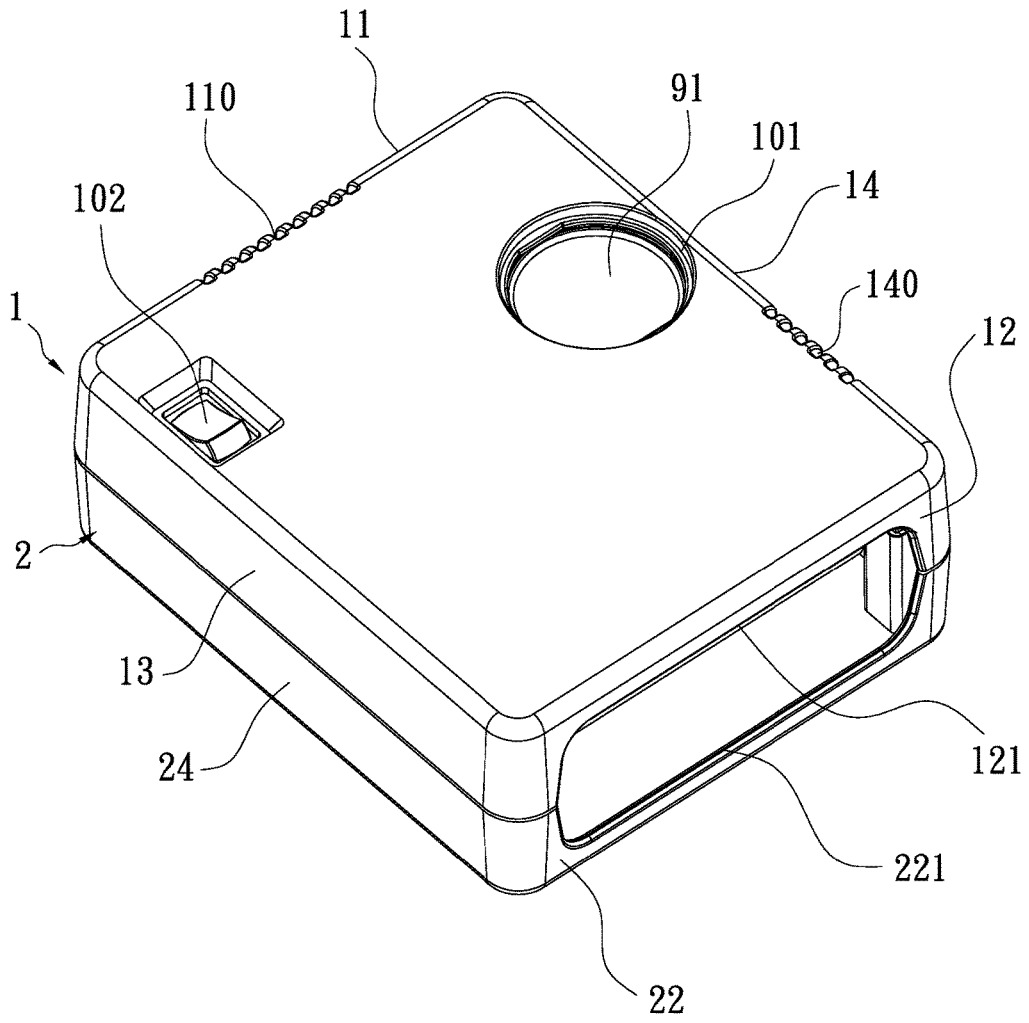
FIG. 1 shows a 3-dimensional view of a portable air compressor according to one embodiment of the present invention.
Figure 2:
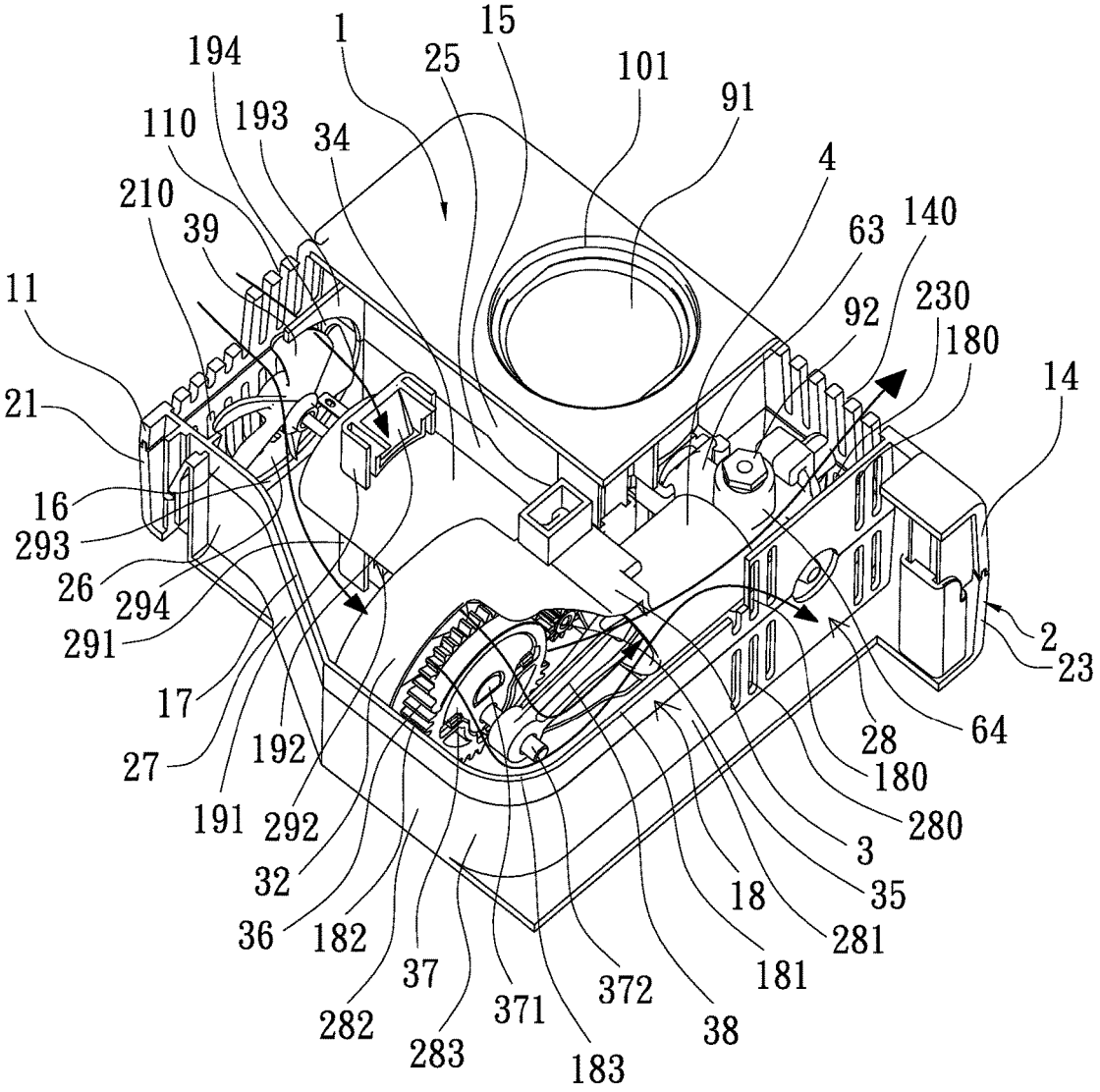
FIG. 2 shows a schematic view of the portable air compressor, wherein a compressor unit and a pressure gauge mounted at the compressor unit and the airflow induced in the box for dissipating heat are demonstrated.
Figure 3:
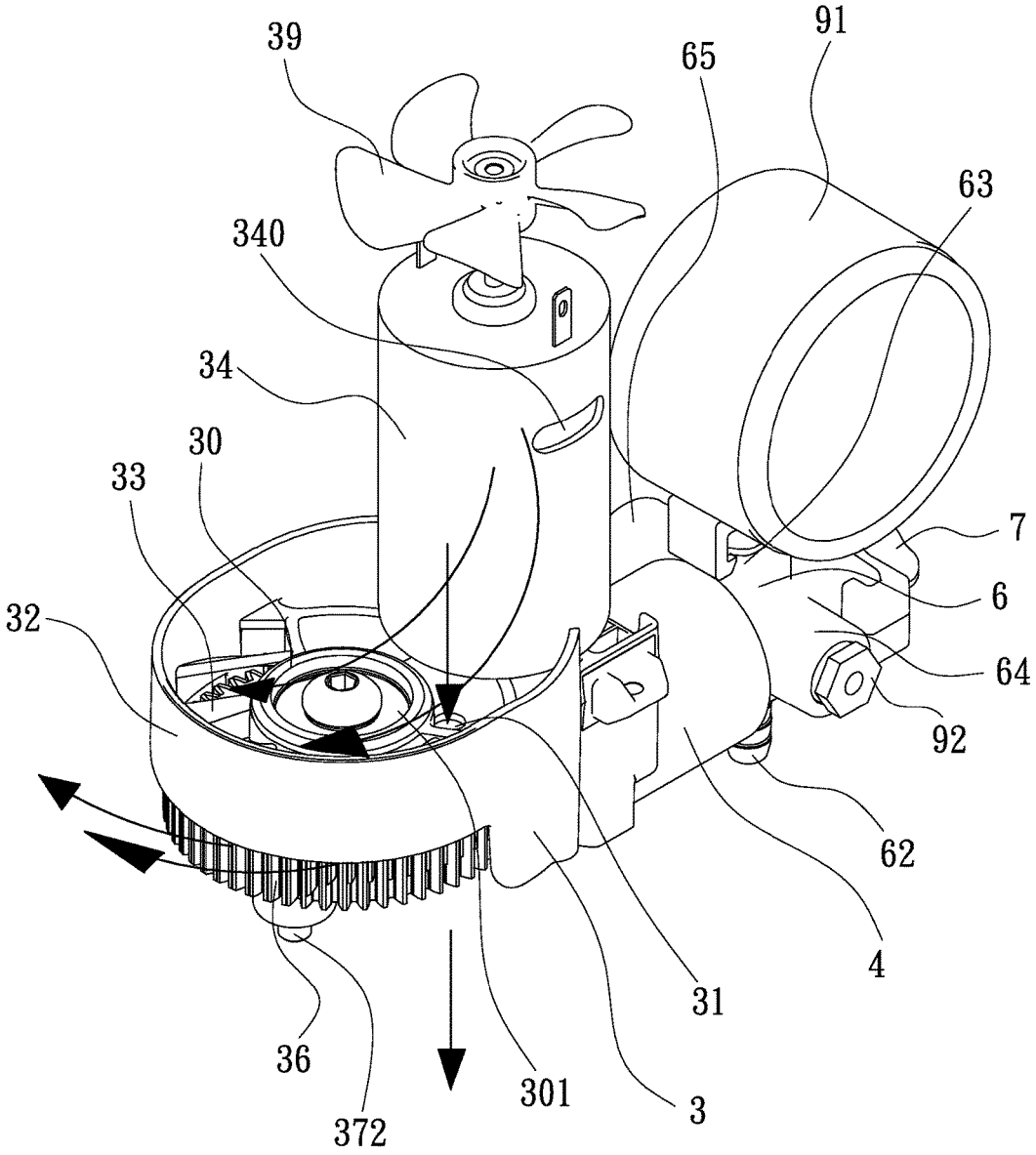
FIG. 3 shows a 3-dimensional view of a first embodiment of the compressor unit.

Referring to FIGS. 1 and 2, a portable air compressor according to one embodiment of the present invention is shown, which generally comprises a box and a compressor unit accommodated in the box. FIG. 3 shows a first embodiment of the compressor unit, which includes a main frame 3, a cylinder 4 fitted with a piston body 38, a motor 34, a cooling fan 39 fitted at an output axle of the motor 34, and a transmission mechanism. The transmission mechanism includes a pinion 35 fitted at the output axle of the motor 34 opposite to the cooling fan 39, a gear 36 engaged with the pinion 35, and a counterweight 37 provided with a crankshaft 371 and a crankpin 372 and attached to the gear 36. The motor 34 and the transmission mechanism are mounted to the main frame 3. The motor 3 can drive the transmission mechanism to have the piston body 38 conduct reciprocating motion along the inner surface 40 of the cylinder 4 to produce compressed air in the inner space 43 of the cylinder 4 (see FIG. 4), which can overcome the urging force of a compression spring 52 to have a plug 51 to move up, so that the compressed air can be transferred to an air storage container 6 provided with a plurality of outlets 62, 63, 64, 65, which can be connected to various devices; for example, the outlet 62 can be connected with a hose (not shown), the outlet 63 can be connected with a pressure gauge 91, and the outlet 64 can be connected with a safety valve 92. One primary feature of the present invention is that the cylinder 4 and the main frame 3 are integrally formed of plastic. In the first embodiment of the compressor unit, the cylinder 4 defines at its top wall 41 an exit hole 42 communicating with the inner space 43 thereof. Furthermore, a metal seat 44, which defines therein a central hole 440, is integrally formed on the top wall 41 of the cylinder 4, above the exit hole 42 of the cylinder 4, wherein the central hole 440 of the metal seat 44 communicates with the exit hole 42 of the cylinder 4. The compressed air produced in the inner space 43 of the cylinder 4 can be transferred to the air storage container 6 via the exit hole 42 of the cylinder 4 and the central hole 440 of the metal seat 44. The plug 51 is provided in the air storage container 6 and urged by the compression spring 52 to seal the central hole 44) of the metal seat 44 when the air pressure in the cylinder 4 is less than a predetermined pressure. The metal seat 44 is capable of enduring high temperature within the cylinder 4 during operation of the compressor unit to ensure air-tightness between the plug 51 and the metal seat 44.

As shown in FIGS. 1 and 2, the box includes a cover 1 and a base 2 corresponding to the cover 1. The cover 1 is provided with a switch 102 electrically connected to the compressor unit and provided with a transparent window 101 over the pressure gauge 91 mounted at the compressor unit, through which a user may read the air pressure in the air storage container 6. The base 2 has a flat bottom and four sidewalls including a front wall 21, a rear wall 22, a right wall 24, and a left wall 23, wherein the front wall 21 defines multiple first slits 210 to serve as an air entrance port, while the left wall 23 defines multiple second slits 230 to serve as an air exit port. The rear wall 22 defines a lower cutout 221. The cover 1 has a flat top and four sidewalls including a front wall 11, a rear wall 12, a right wall 13, and a left wall 14, wherein the front wall 11 defines multiple first slits 110 to serve as an air entrance port, while the left wall 14 defines multiple second slits 140 to serve as an air exit port. The rear wall 12 defines an upper cutout 121. The cover 1 is provided with a plurality of upper partitioning walls, while the base 2 is provided with a plurality of lower partitioning walls corresponding to the upper partitioning walls. The upper and lower partitioning walls define a substantially L-shaped space and a substantially rectangular space. The substantially L-shaped space is used for sequentially accommodating the control unit, which includes the cooling fan 39, the motor 34, the main frame 3 with the transmission mechanism, the cylinder 4 with the piston body 38, and the air storage container 6, wherein the cooling fan 39 is located near the first slits 110, 210, while the air storage container 6 is located near the second slits 140, 230. The substantially rectangular space is used for accommodating the pressure gauge 91. In this arrangement, outside air can be drawn by the cooling fan 39 to induce an airflow that flows through the first slits 110, 210 to enter the box and flow along the generally L-shaped space and finally discharge into the environment via the second slits 140, 230, thus dissipating the heat generated by the compressor unit.

The lower partitioning walls include a first L-shaped wall 25, a short straight wall 26, an outwardly angled wall 27, and a second L-shaped wall 28 composed of a first straight part 281, a second straight part 282, and a curved part 283 therebetween. One end of the first L-shaped wall 25 is joined to the front wall 21, while the other end of the first L-shaped wall 25 is joined to the left wall 23. One end of the short straight wall 26 is joined to the front wall 21, while the other end of the short straight wall 26 is joined to one end of the outwardly angled wall 27. The first straight part 281 of the second L-shaped wall 28 is joined to the left wall 23. The second straight part 282 of the second L-shaped wall 28 is joined to the other end of the outwardly angled wall 27. Furthermore, the second L-shaped wall 28 defines a plurality of third slits 280 at its first straight part 281, near the second slits 230 of the left wall 23, so that the heat generated by the compressor unit can be dissipated more easily. The front wall 21, the first L-shaped wall 25, the left wall 23, the second L-shaped wall 28, the outwardly angled wall 27, and the short straight wall 26 define a lower portion of the substantially L-shaped space. The front wall 21, the left wall 23, and the first L-shaped wall 25 define a lower portion of the substantially rectangular space.

The upper partitioning walls include a first L-shaped wall 15, a short straight wall 16, an outwardly angled wall 17, and a second L-shaped wall 18 composed of a first straight part 181, a second straight part 182, and a curved part 183 therebetween. One end of the first L-shaped wall 15 is joined to the front wall 11, while the other end of the first L-shaped wall 15 is joined to the left wall 14. One end of the short straight wall 16 is joined to the front wall 11, while the other end of the short straight wall 16 is joined to one end of the outwardly angled wall 17. The first straight part 181 of the second L-shaped wall 18 is joined to the left wall 14. The second straight part 182 of the second L-shaped wall 18 is joined to the other end of the outwardly angled wall 17. Furthermore, the second L-shaped wall 18 defines a plurality of third slits 180 at its first straight part 181, near the second slits 140 of the left wall 14, so that the heat generated by the compressor unit can be dissipated more easily. The front wall 11, the first L-shaped wall 15, the left wall 14, the second L-shaped wall 18, the outwardly angled wall 17, and the short straight wall 16 define an upper portion of the substantially L-shaped space. The front wall 11, the left wall 14, and the first L-shaped wall 15 define an upper portion of the substantially rectangular space.

Referring to FIG. 3, the main frame 3 has two axle-supporting portions 30, one of which is for mounting the motor 34 and the other of which is provided with a bearing 301 for mounting the crankshaft 371 provided at the counterweight 37 and inserted through the gear 36. The crankpin 372 is pivotally connected to the piston body 38. The piston body 38 defines an intake channel 380 extending through its head 381 (see FIG. 7 instead of FIG. 4), which allows the airflow induced by the cooling fan 39 to flow into the inner space 43 of the cylinder 4 in addition to flowing over the cylinder 4. The main frame 3 defines two air passing holes 31 at two sides of the axle-supporting portions 30. The main frame 3 has a peripheral wall 32, which is partially around the bearing 301, and has a plurality of beveled radial braces 33 provided between the peripheral wall 32 and the axle-supporting portion that holds the bearing 301 to facilitate the airflow, which is a generally spiral flow, to flow through the main frame 3, thus effectively dissipating the heat generated in the bearing 301 and the transmission mechanism. The motor 34 can drive the pinion 35 to rotate the gear 36 to have the crankpin 372 swing in a circle, so that the piston body 38 can conduct reciprocating motion in the cylinder 4 and the compressed air produced in the inner space 43 can be transferred to the air storage container 6.

Figure 4:
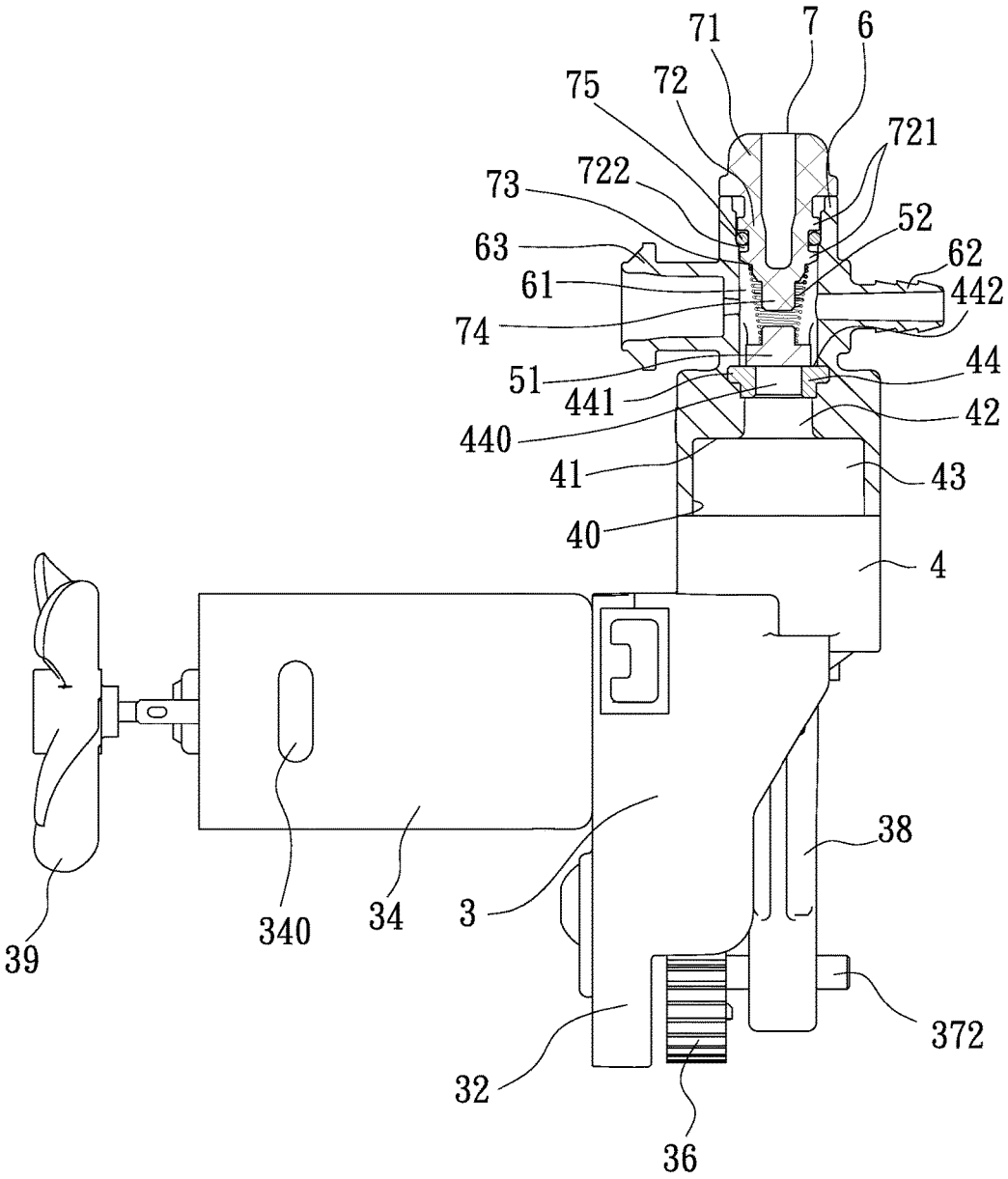
FIG. 4 shows a sectional view of the first embodiment of the compressor unit.
Figure 5:
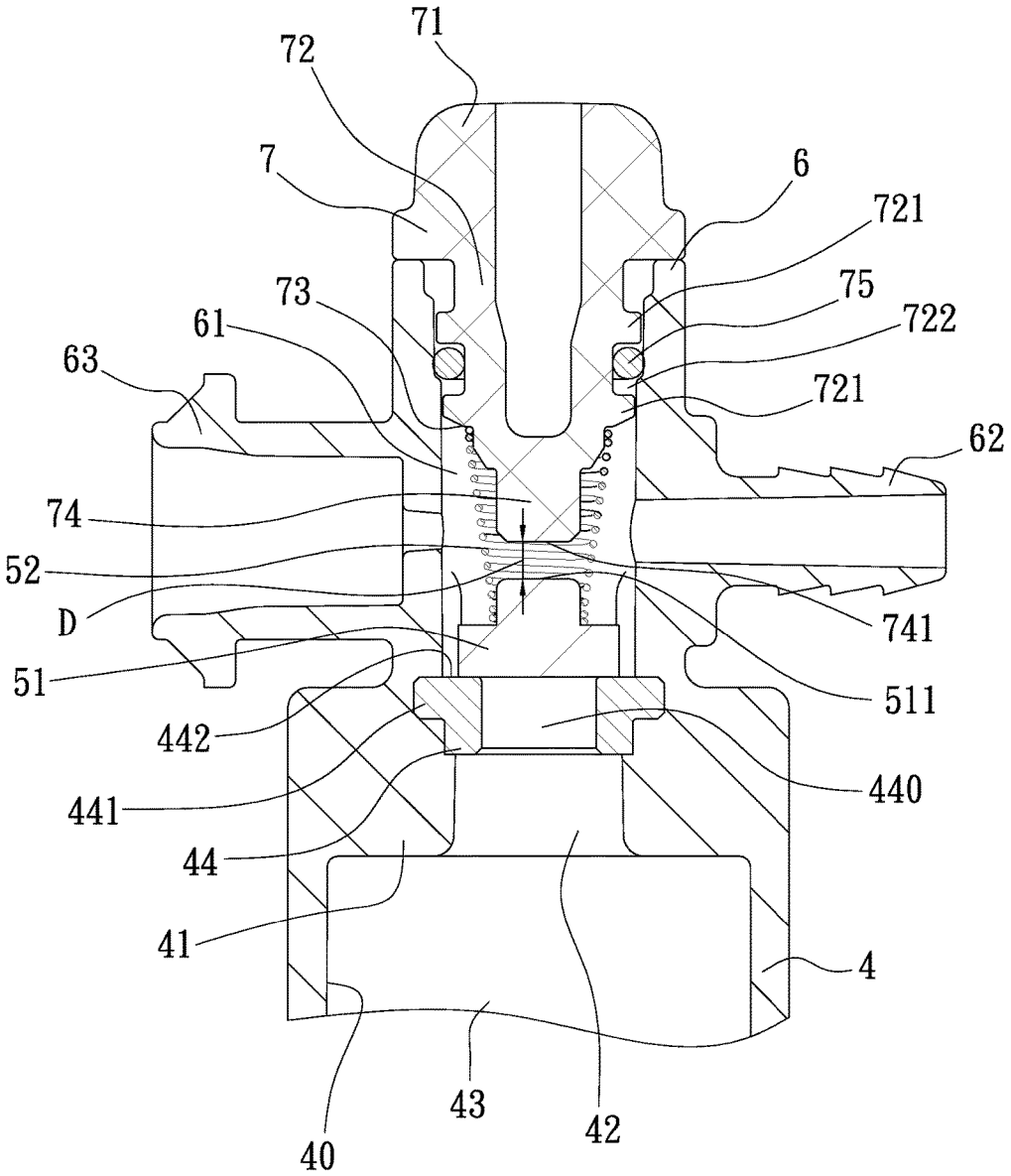
FIG. 5 shows an enlarged, partially sectional view of the first embodiment of the compressor unit.

FIGS. 3 through 5 show the first embodiment of the compressor unit, wherein the air storage container 6, which has an open top, is integrally formed on the top wall 41 of the cylinder 4. The top wall 41 of the cylinder 4 defines the exit hole 42, which communicates with the inner space 43 of the cylinder 4. The metal seat 44 has a top flange 441, which is embedded in the top wall 41 of the cylinder 4, so that the metal seat 44 is integrally formed at the cylinder 4, above the exit hole 42. The top flange 441 has a top annular surface 442. The plug 51 is urged by the compression spring 52 against the top annular surface 442 of the top flange 441 of the metal seat 44. The inner space 43 of the cylinder 4 can communicate with the inner space 61 of the air storage cylinder 6 via the exit hole 42 of the cylinder 4 and the central hole 440 of the metal seat 44. As shown in FIG. 5, the plug 51, which has a top surface 511, is placed within the air storage container 6, above the central hole 440 of the metal seat 44. The exit hole 42 of the cylinder 4 and the central hole 440 of the metal seat 44 are configured such that the sum of the length of the exit hole 42 and the length of the central hole 440 is greater than the permissible displacement of the plug 51 being away from the metal seat 44, so that the exit hole 42 of the cylinder 4 together with the central hole 440 of the metal seat 44 can serve as an auxiliary chamber effectively for storing additional compressed air. In the first embodiment of the compressor unit, a cap 7 is employed to seal the open top of the air storage container 6. The cap 7 has a rotating handle 71 at its outer surface and a central column 72 extending downwardly from its inner surface. The central column 72 has a base portion and a reduced portion 74 extending from the base portion, wherein a step 73 is formed between the base portion and the reduced portion 74. The base portion of the central column 72 is provided with a plurality of annular protrusions 721 and defines one or more annular grooves 722 between the annular protrusions 721 for accommodating at least one seal ring 75. One end of the compression spring 52 is fitted around the reduced portion 74 of the central column 72 and urged against a lowest one of the annular protrusions 721 of the central column 72, while the other end of the compression spring 52 is urged against the plug 51. The central column 72 has a bottom surface 741 formed at the free end of the reduced portion 74 thereof, which may contact the top surface 511 of the plug 51 to limit upward movement of the plug 51. As shown in FIG. 4, the cap 7 can be rotated to assemble to the air storage container 6 by conventional coupling means (not shown). Referring to FIG. 5, the distance (D) between the bottom surface 741 of the central column 74 and the top surface 511 of the plug 51 is configured to control the flow rate of compressed air being transferred to the air storage container 6. Also, the distance (D) can be used to control the noise level of compressed air being transferred to the air storage container 6. The more the distance (D) is configured, the more the flow rate and noise level of the compressed air is obtained. For a compressor unit requiring more output of compressed air, the length of the reduced portion 74 of the central column 72 can be decreased, so that the distance (D) between the bottom surface 741 of the central column 74 and the top surface 511 of the plug 51 can be increased. For a compressor unit requiring less output of compressed air, the length of the reduced portion 74 of the central column 72 can be increased, so that the distance (D) between the bottom surface 741 of the central column 72 and the top surface 511 of the plug 51 can be decreased.

The plug 51 is employed to control the output of the compressed air produced in the inner space 43 of the cylinder 4. When the compressor unit is stopped, the plug 51 is urged by the compression spring 52 to seal the central hole 440 of the metal seat 44 (see FIG. 5). Because the top annular surface 442 of the metal seat 44 can keep smooth after a period of use, air-tightness between the plug 51 and the metal seat 44 can be maintained excellently.

The exit hole 42 defined at the top wall 41 of the cylinder 4 and the central hole 440 of the metal seat 44 may serve as an auxiliary chamber for storing additional compressed air. Thus, when the piston body 38 is moved to approach TDC (top dead center), although the head 381 of the piston body 38 is near the top wall 41 (see FIG. 7 instead of FIG. 4), the auxiliary chamber can store additional compressed air, so that the motion resistance of the piston body 38 can be reduced and thus the piston body 38 can conduct reciprocating motion more smoothly. In addition, an object connected to an output of the air storage container 6 can be prevented from being overly inflated, so that the object can be protected from damages.

Referring back to FIG. 2, the cover 1 is provided with an upper wall 193 behind the front wall 11, between the first L-shaped wall 15 and the short straight wall 16, wherein the upper wall 193 has a concave bottom edge. The base 2 is provided with a lower wall 293 behind the front wall 21, between the first L-shaped wall 25 and the short straight wall 26, wherein the lower wall 293 has a concave top edge. The upper wall 193 and the lower wall 293 define therebetween a round opening, which is composed of an upper part 194 and a lower part 294, for receiving the cooling fan 39. The round opening has a dimension slightly greater than the cooling fan 39, so that the turbulence of the airflow induced by the cooling fan 39 to enter the generally L-shaped space can be reduced. As such, the cooling fan 39 can draw outside air to smoothly flow through the first slits 110, 210 and the round opening defined between the upper wall 193 and the lower wall 293 to enter the generally L-shaped space. For improving heat dissipation, the motor 34 defines two opposite openings 340 at its surrounding wall (see FIG. 3); the base 2 is provided at its flat bottom with a lower airflow-guiding member 291 having a slant surface 292 directed towards one of the two openings 340 of the motor 34 (see FIG. 2); the cover 1 is provided at its flat top with an upper airflow-guiding member 191 having a slant surface 192 directed towards the other one of the two openings 340 of the motor 34 (see FIG. 2). Thus, the airflow induced by the cooling fan 39 can flow through the openings 340 of the motor 34 to enter the interior of the motor 34 for dissipating the heat generated in the motor 34, so that the motor 34 can be prevented from being burnt and thus the service life of the motor 34 can be prolonged. Additionally, the short straight walls 16, 26 and the outwardly angled wall 17, 27 can guide the airflow to reach the peripheral wall 32 of the main frame 3. Thereafter, the beveled radial braces 33 can facilitate the airflow, which is a generally spiral flow, to flow through the main frame 3 to dissipate the heat generated in the bearing 301 and the transmission mechanism (see FIG. 3). Furthermore, the air passing holes 31 of the main frame 3 can assist the airflow to flow through the main frame 3. Thereafter, the second L-shaped walls 18, 28 can guide the airflow to reach the cylinder 4, wherein one part of the airflow may flow over the cylinder 4 and finally flow out of the generally L-shaped space via the second slits 140 of the left wall 14 of the cover 1, the second slits 230 of the left wall 23 of the base 2, the third slits 180 of the second L-shaped wall 18 of the cover 1, or the third slits 280 of the second L-shaped wall 28 of the base 2, to dissipate the heat of the cylinder 4; another part of the airflow may flow through the intake channel 380 of the piston body 38 to enter the inner space 43 of the cylinder 4 (see FIG. 7 instead of FIG. 4), so that the heat generated in the cylinder 4 can be dissipated more quickly.

Figure 6:
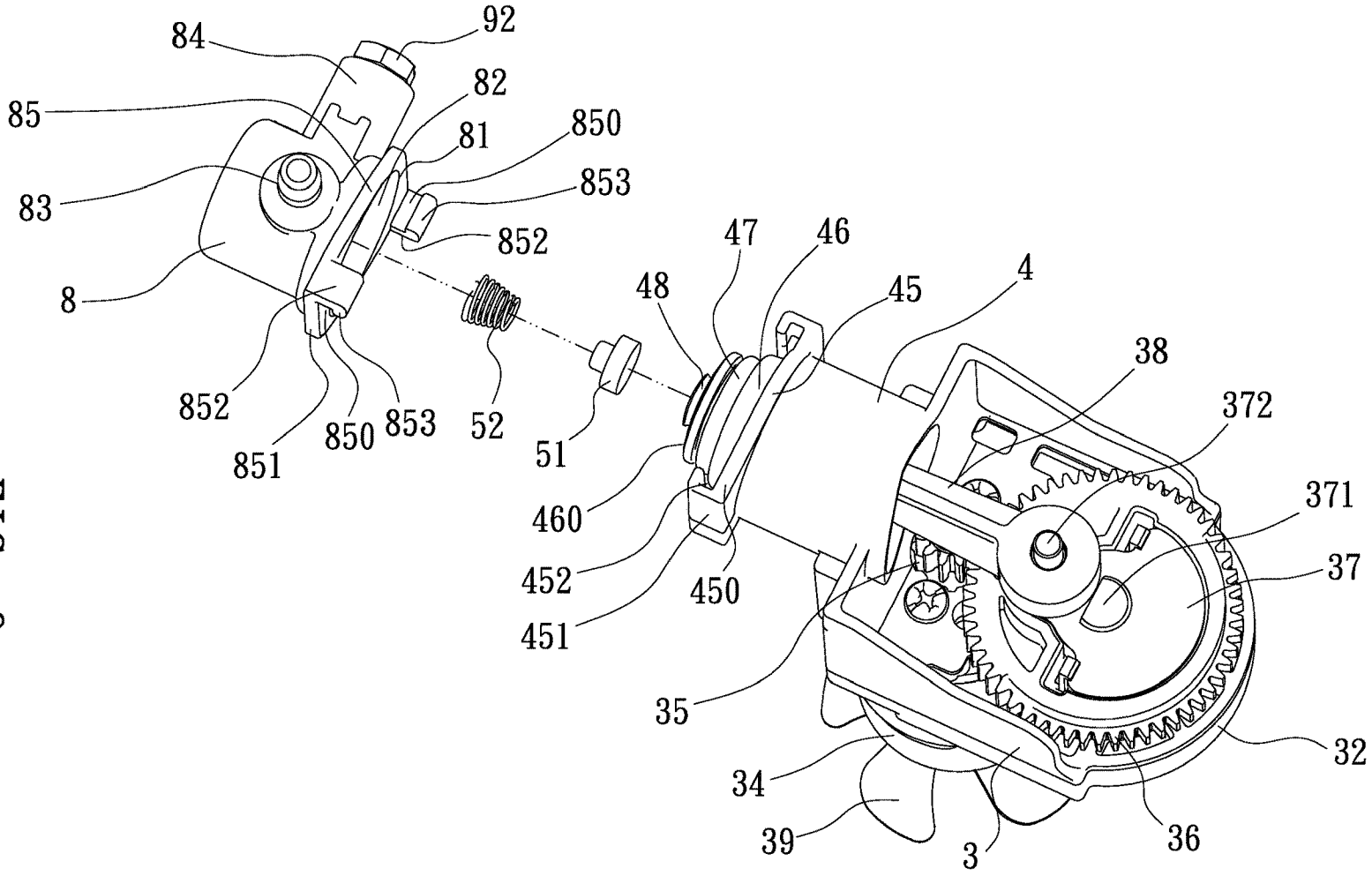
FIG. 6 shows an exploded view of a second embodiment of the compressor unit.

FIG. 6 show a second embodiment of the control unit, wherein the air storage container 8 is a separate body from the cylinder 4. The cylinder 4 is provided with a coupling flange 45 having two opposite sides 450, each of which is provided with an L-shaped holder 451 defining a recess 452. In the second embodiment of the control unit, the cylinder 4 is provided with a tubular connection portion 46 on the top wall 41 of the cylinder 4, wherein the tubular connection portion 46 defines at its outer surface with an annular groove 461 to be inserted with a seal ring 47 and defines therein an exit hole 42 communicating the inner space 43 of the cylinder 4. In addition, the tubular connection portion 46 has a top annular surface 460. The metal seat 48 has a flared tubular projection 482 and a flange 481 formed at the bottom edge of the flared tubular projection 482, wherein the tubular projection 482 has a top annular surface 483 and defines a central hole 480 communicating with the exit hole 42 of the cylinder 4. The flange 481 of the metal seat 48 is embedded into the top annular surface 460 of the tubular connection portion 46, so that the metal seat 48 is integrally formed at the cylinder 4, above the exit hole 42 of the cylinder 4. The inner space 43 of the cylinder 4 can communicate with the inner space 82 of the air storage cylinder 8 via the exit hole 42 of the cylinder 4 and the central hole 480 of the metal seat 48. The compressed air produced in the inner space 43 of the cylinder 4 can be transferred to the inner space 82 of the air storage container 8 via the exit hole 42 of the cylinder 4 and the central hole 480 of the metal seat 48. The plug 51, which is placed above the metal seat 48, can be urged by the compression spring 51 to contact the top annular surface 483 of the metal seat 48 (see FIGS. 7 and 8). The exit hole 42 of the cylinder 4 and the central hole 480 of the metal seat 48 are configured such that the sum of the length of the exit hole 42 and the length of the central hole 480 is greater than the permissible displacement of the plug 51 being away from the metal seat 48, so that the exit hole 42 of the cylinder 4 together with the central hole 480 of the metal seat 48 is able to serve as an auxiliary chamber effectively for storing additional compressed air.

The air storage container 8 has a closed top and a surrounding wall extending from the closed top to define the inner space 82 that terminates at an open bottom 81 opposite to the closed top. The open bottom 81 of the air storage container 8 is provided with a coupling flange 85 having two opposite sides 851, each of which is provided with an L-shaped hook, which is composed of a base section 852 and an end section 853 and defines a recess 850 between the end section 853 and the corresponding side of the coupling flange 85. The closed top of the air storage container 8 is provided at its inner surface with a central column 86 and an annular protrusion 87 around the central column 86, thus defining an annular groove 80 therebetween. One end of the compression spring 52 is fitted around the central column 86 and received in the annular groove 80, while the other end of the compression spring 52 is urged against the plug 51 (see FIGS. 7 and 8). The air storage container 8 is provided with a plurality of outlets 83, 84, which can be connected to various devices; for example, the outlet 83 can be connected with a hose (not shown), and the outlet 84 can be connected with a safety valve 92 (see FIG. 6).

Figure 7:
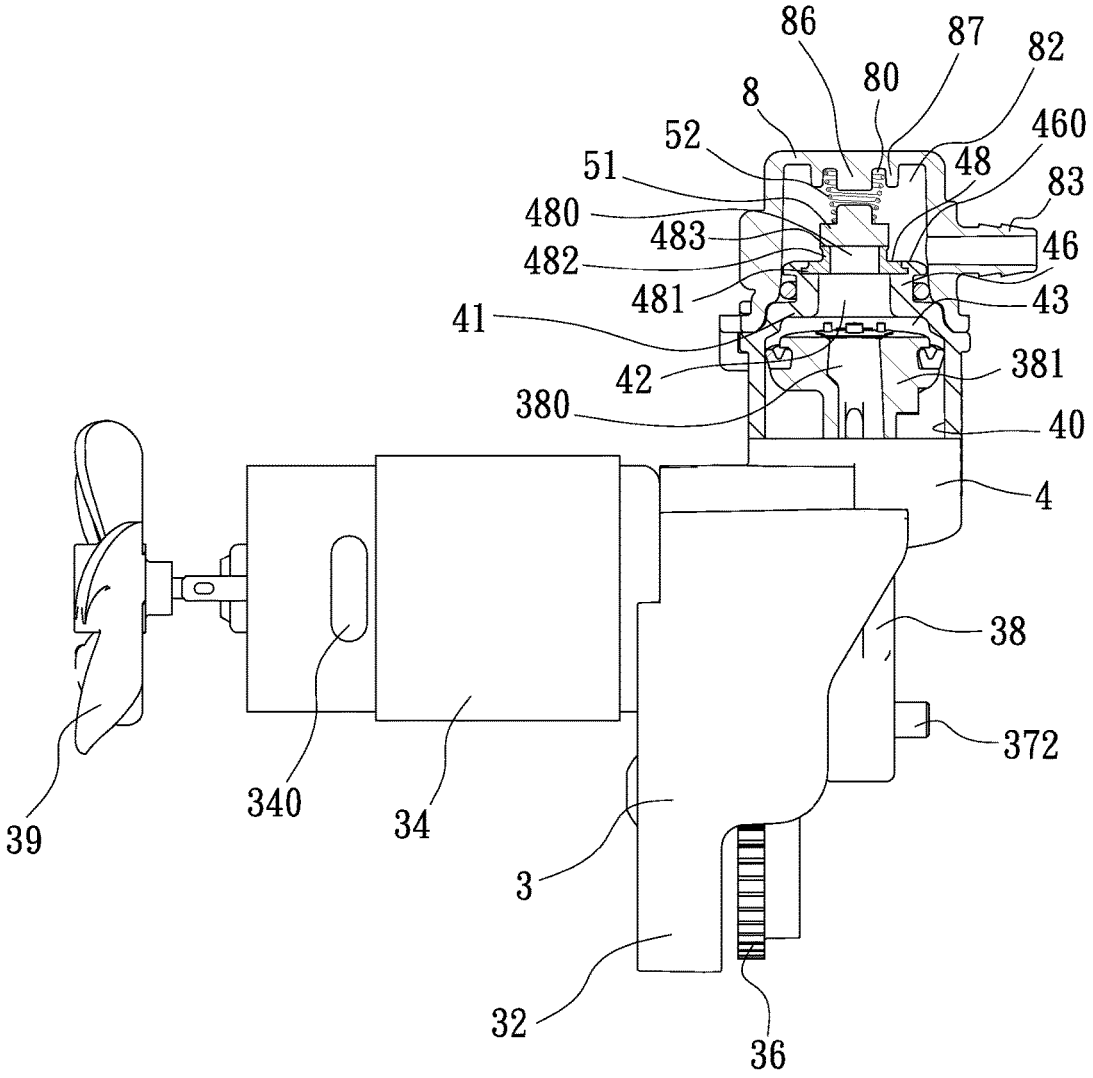
FIG. 7 shows a sectional view of the second embodiment of the compressor unit.
Figure 8:
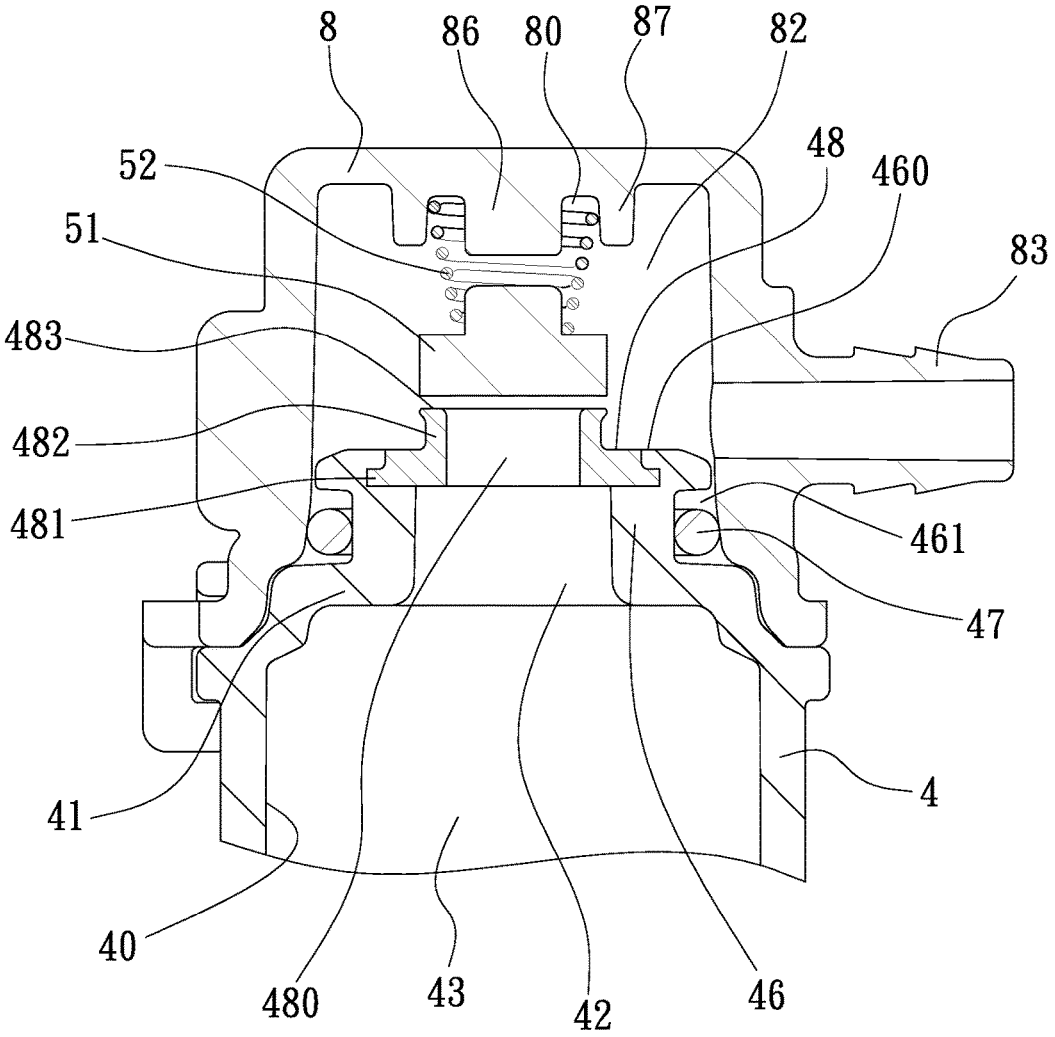
FIG. 8 shows an enlarged, partially sectional view of the second embodiment of the compressor unit.

As shown in FIGS. 6, 7 and 8, the air storage container 8 is capable of being fitted over the tubular connection portion 46 of the cylinder 4 and rotated about the cylinder 4 to have the opposite sides 851 of its coupling flange 85 to slide in the recesses 452 of the coupling flange 45 of the cylinder 4 and have the opposite sides 450 of the coupling flange 45 of the cylinder 4 slide in the recesses 850 of the coupling flange 85 of the air storage container 8, wherein the L-shaped holders 451 of the coupling flange 45 of the cylinder 4 and the base sections 852 of the coupling flange 85 of the air storage container 8 are mutually blocked and thus the air storage container 8 is detachably mounted to the cylinder 4. Therefore, the compressed air produced in the inner space 43 of the cylinder 4 can be transferred to the inner space 82 of the air storage container 8 via the exit hole 42 of the cylinder 4 and the central hole 480 of the metal seat 48.

As a summary, the present invention provides a portable air compressor, which comprises a box and an electrically operated compressor unit accommodated in the box. The compressor unit includes a main frame 3 and a cylinder 4. The frame 3 is mounted with a motor 34. The cylinder 4 is fitted with a piston body 38. The main frame 4 and the cylinder 4 are integrally formed of plastic. The top of the cylinder 4 defines an exit hole 42 communicating with the inner space 43 of the cylinder 4 and is provided with a metal seat defining a central hole communicating with the exit hole 42 of the cylinder 4. A plug 51 is urged by a compression spring 52 to seal the central hole of the metal seat when the air pressure in the cylinder is less than a predetermined pressure. Due to the metal seat being able to endure high temperature during operation of the compressor unit, airtightness between the plug 51 and the metal seat can be maintained excellently.

I claim:

1. In an air compressor including a box and an electrically operated compressor unit accommodated in the box, the compressor unit including a main frame, a cylinder fitted with a piston body, a motor, and a transmission mechanism, the motor and the transmission mechanism being mounted to the main frame, the motor driving the transmission mechanism to have the piston body conduct reciprocating motion in the cylinder to produce compressed air in an inner space of the cylinder, which is capable of being transferred to an air storage container provided with a plurality of outlets; wherein the improvement comprises: the cylinder and the main frame are integrally formed of plastic, the cylinder defining an exit hole communicating with the inner space thereof; a metal seat defining therein a central hole is integrally formed at the cylinder, above the exit hole of the cylinder, the central hole of the metal seat communicating with the exit hole of the cylinder, the compressed air produced in the inner space of the cylinder being transferred to the air storage container via the exit hole of the cylinder and the central hole of the metal seat; a plug is provided in the air storage container and urged by a compression spring to seal the central hole of the metal seat when the air pressure in the cylinder is less than a predetermined pressure; wherein the metal seat is capable of enduring operating temperature within the cylinder during operation of the compressor unit to ensure air-tightness between the plug and the metal seat, wherein the box includes a cover and a base corresponding to the cover, the cover being provided with a switch electrically connected to the compressor unit and provided with a transparent window over a pressure gauge mounted at the compressor unit, the box defining an air entrance port and an air exit port, the cover being provided with a plurality of upper partitioning walls, the base being provided with a plurality of lower partitioning walls corresponding to the upper partitioning walls, so that a substantially L-shaped space and a substantially rectangular space are defined; wherein the substantially L-shaped space is used for sequentially accommodating a cooling fan mounted at an output axle of the motor, the motor, the main frame with the transmission mechanism, the cylinder with the piston body, and the air storage container, the cooling fan being located near the air entrance port while the air storage container being located near the air exit port; the substantially rectangular space is used for accommodating the pressure gauge; wherein outside air is drawn by the cooling fan to induce an airflow that flows through the air entrance port to enter the box and flow along the L-shaped space and finally discharge into the environment via the air exit port, thus dissipating heat generated by the compressor unit, wherein the base has a flat bottom and four sidewalls including a front wall, a rear wall, a right wall, and a left wall, the front wall of the base defining multiple first slits to serve as the air entrance port while the left wall of the base defining multiple second slits to serve as the air exit port, the rear wall of the base defining a lower cutout; the upper partitioning walls include a first L-shaped wall, a short straight wall, an outwardly angled wall, and a second L-shaped wall composed of a first straight part, a second straight part, and a curved part therebetween, one end of the first L-shaped wall of the base being joined to the front wall of the base while the other end of the first L-shaped wall of the base being joined to the left wall of the base, one end of the short straight wall of the base being joined to the front wall of the base while the other end of the short straight wall being joined to one end of the outwardly angled wall of the base, the first straight part of the second L-shaped wall of the base being joined to the left wall of the base, the second straight part of the second L-shaped wall of the base being joined to the other end of the outwardly angled wall of the base, the second L-shaped wall defines a plurality of third slits at its first straight part, near the second slits of the left wall, the front wall of the base, the first L-shaped wall of the base, the left wall of the base, the second L-shaped wall of the base, the outwardly angled wall of the base, and the short straight wall of the base defining a lower portion of the substantially L-shaped space, the front wall of the base, the left wall of the base, and the first L-shaped wall of the base defining a lower portion of the substantially rectangular space; the cover has a flat top and four sidewalls including a front wall, a rear wall, a right wall, and a left wall, the front wall of the cover defining multiple first slits to serve as the air entrance port while the left wall of the cover defining multiple second slits to serve as the air exit port, the rear wall of the cover defining an upper cutout; the upper partitioning walls include a first L-shaped wall, a short straight wall, an outwardly angled wall, and a second L-shaped wall composed of a first straight part, a second straight part, and a curved part therebetween, one end of the first L-shaped wall of the cover being joined to the front wall of the cover while the other end of the first L-shaped wall of the cover being joined to the left wall of the cover, one end of the short straight wall of the cover being joined to the front wall of the cover while the other end of the short straight wall being joined to one end of the outwardly angled wall of the cover, the first straight part of the second L-shaped wall of the cover being joined to the left wall of the cover, the second straight part of the second L-shaped wall of the cover being joined to the other end of the outwardly angled wall of the cover, the second L-shaped wall of the cover defining a plurality of third slits at its first straight part, near the second slits of the left wall of the cover, the front wall of the cover, the first L-shaped wall of the cover, the left wall of the cover, the second L-shaped wall of the cover, the outwardly angled wall of the cover, and the short straight wall of the cover defining an upper portion of the substantially L-shaped space, the front wall of the cover, the left wall of the cover, and the first L-shaped wall of the cover defining an upper portion of the substantially rectangular space; wherein the cooling fan is located between the first L-shaped walls and the short straight walls; the motor is located between the first L-shaped walls and the outwardly angled walls; the main frame together with the transmission mechanism is located near the curved parts of the second L-shaped walls; the cylinder and the air storage tank are located between the first L-shaped walls and the first straight part of the second L-shaped walls; the piston body is parallel to the first straight part of the second L-shaped wall; whereby the airflow induced by the cooling fan to enter the box is guided by the short straight walls, the outwardly angled walls and the second L-shaped walls to sequentially pass the motor, the main frame, the transmission mechanism, the cylinder with the piston body, and the air storage tank of the compressor unit, to take away the heat generated by the foregoing parts of the compressor unit.

2. The air compressor of claim 1, wherein the motor defines two opposite openings at its surrounding wall; the base is provided at its flat bottom with a lower airflow-guiding member having a slant surface directed towards one of the two openings of the motor; the cover is provided at its flat top with an upper airflow-guiding member having a slant surface directed towards the other one of the two openings of the motor; whereby the airflow induced by the cooling fan to enter the box can flow through the openings of the motor to enter the interior of the motor for dissipating heat generated in the motor, so that the motor can be prevented from being burnt.

3. The air compressor of claim 2, wherein the transmission mechanism includes a pinion fitted at the output axle of the motor opposite to the cooling fan, a gear engaged with the pinion, and a counterweight provided with a crankshaft and a crankpin and attached to the gear, the main frame having two axle-supporting portions, one of which is for mounting the motor and the other of which is provided with a bearing for mounting the crankshaft provided at the counterweight, the crankpin being pivotally connected to the piston body, the piston body defining an intake channel extending through its head, which allows the airflow induced by the cooling fan to flow into the inner space of the cylinder in addition to flowing over the cylinder, the main frame defining two air passing holes at two sides of the axle-supporting portions, the main frame having a peripheral wall being partially around the bearing and has a plurality of beveled radial braces provided between the peripheral wall and the axle-supporting portion that holds the bearing to facilitate the airflow to flow through the main frame, thus effectively dissipating heat generated in the bearing and the transmission mechanism.

4. The air compressor of claim 3, wherein the cover is provided with an upper wall behind the front wall of the cover, between the first L-shaped wall and the short straight wall of the cover, the upper wall having a concave bottom edge; the base is provided with a lower wall behind the front wall of the base, between the first L-shaped wall and the short straight wall of the base, the lower wall having a concave top edge, the upper wall and the lower wall defining a round opening therebetween for receiving the cooling fan, the round opening having a dimension greater than the cooling fan, so that the turbulence of the airflow induced by the cooling fan to enter the L-shaped space can be reduced.

5. The air compressor of claim 4, wherein the air storage container having an open top is integrally formed on a top wall of the cylinder, the exit hole being defined at the top wall of the cylinder; the metal seat has a top flange being embedded in the top wall of the cylinder, so that the metal seat is integrally formed at the cylinder, above the exit hole of the cylinder, the central hole of the metal seat communicating an inner space of the air storage container, the top flange having a top annular surface; the plug is urged by the compression spring against the top annular surface of the top flange of the metal seat.

6. The air compressor of claim 5, wherein the exit hole of the cylinder and the central hole of the metal seat are configured such that a sum of the length of the exit hole and the length of the central hole of the metal seat is greater than a permissible displacement of the plug being away from the metal seat, so that the exit hole of the cylinder together with the central hole of the metal seat is able to serve as an auxiliary chamber effectively for storing additional compressed air.

7. The air compressor of claim 6, wherein a cap is adapted to seal the open top of the air storage container, the cap having a rotating handle at its outer surface and a central column extending downwardly from its inner surface, the central column having a base portion and a reduced portion extending from the base portion such that a step is formed therebetween, the base portion of the central column being provided with a plurality of annular protrusions and defining one or more annular grooves between the annular protrusions for accommodating at least one seal ring, one end of the compression spring being fitted around the reduced portion of the central column and urged against a lowest one of the annular protrusions of the central column while the other end of the compression spring is urged against the plug.

* * * * *